United States Patent [19]

Hunt

[11] 4,196,572

[45] Apr. 8, 1980

[54] TEXTILE WINDING APPARATUS

[75] Inventor: Robert J. Hunt, Belfast, Northern Ireland

[73] Assignee: James Mackie & Sons Limited, Belfast, Northern Ireland

[21] Appl. No.: 940,672

[22] Filed: Sep. 8, 1978

[30] Foreign Application Priority Data

Sep. 13, 1977 [GB] United Kingdom ..... 38099/77

[51] Int. Cl.[2] ..... D01H 1/26; D01H 1/36

[52] U.S. Cl. ..... 57/96; 57/70; 57/100

[58] Field of Search ..... 57/92, 93, 94, 96, 100, 57/66-71, 72, 97; 242/45, 75.51, 26.1

[56] References Cited

U.S. PATENT DOCUMENTS

| | | | |
|---|---|---|---|
| 1,778,907 | 10/1930 | Moorhouse | 57/70 |
| 3,015,203 | 1/1962 | Heiberg | 57/93 |
| 3,742,268 | 6/1973 | Volkrodt | 57/100 X |
| 4,128,988 | 12/1978 | Ragan | 57/100 X |

*Primary Examiner*—Donald Watkins

*Attorney, Agent, or Firm*—Sughrue, Rothwell, Mion, Zinn and Macpeak

[57] ABSTRACT

A textile winding head of the driven flyer type having a rotary bobbin carrier is provided with an adjustable brake of the electromagnetic induction type, preferably of the regenerative type, and a controller for increasing the braking torque progressively as the diameter of the package increases during winding so as to maintain close control over the tension of the material being wound. A tachogenerator may be connected to turn with the bobbin carrier to provide a signal varying with the angular velocity of a package being wound to provide an input signal to the controller for adjusting the braking torque. Additional tachogenerators may be connected to turn respectively with the delivery rollers and the flyer to provide correction signals, and the controller is preferably a computer for receiving the signals from the three tachogenerators and for providing an output signal for adjusting the braking torque. The brake is preferably an electric motor connected regeneratively and this may control more than one winding head, the torque being reduced automatically in the event of an end break.

9 Claims, 1 Drawing Figure

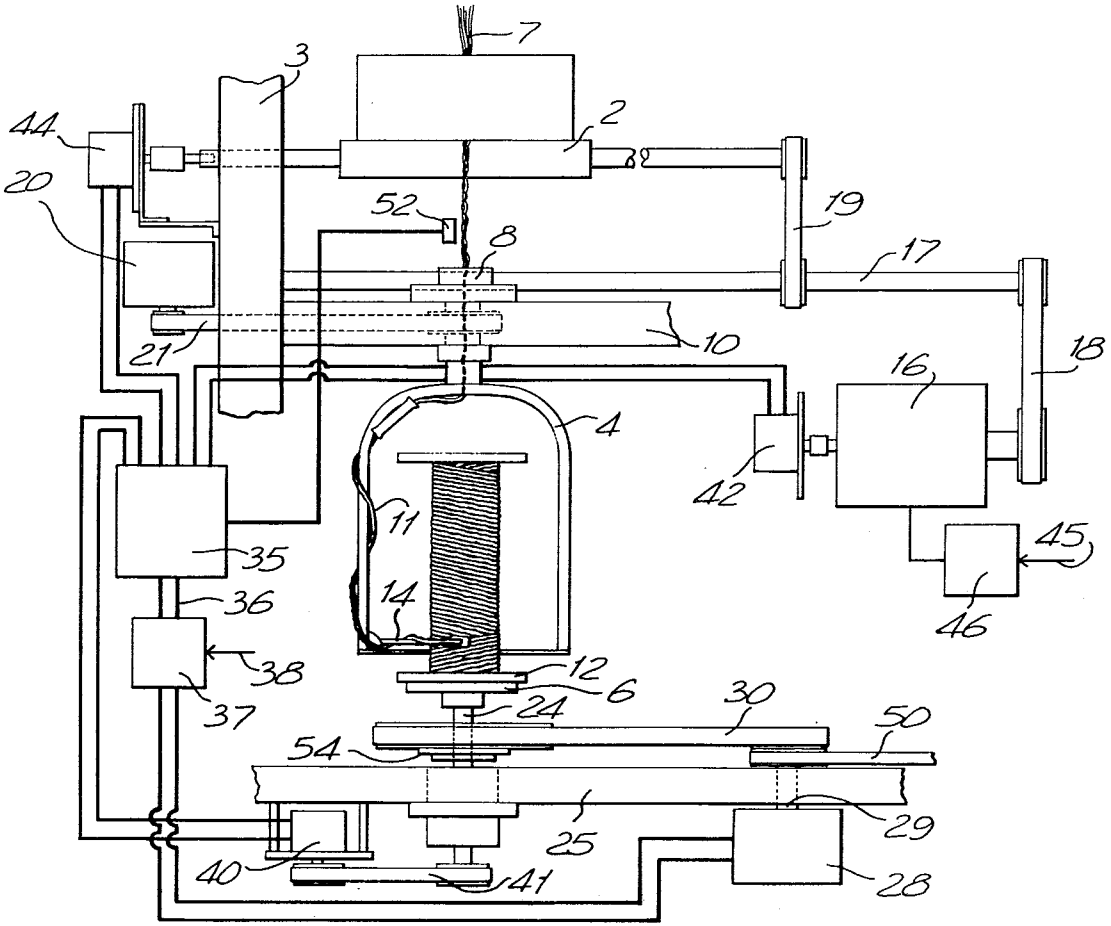
7
2
3
44
20
21
8
52
10
19
17
18
16
45
46
42
4
11
14
12
6
24
50
30
54
29
28
25
41
40
35
36
38
37

TEXTILE WINDING APPARATUS

This invention relates to textile winding apparatus of the driven flyer type, that is to say apparatus including spinning heads, twisting heads and package-forming heads. In each case the winding action is accompanied by a twisting action, the twist being highest in the case of the spinning head and lowest for a package-forming head which is commonly used for the winding of rove or sliver when the twist introduced is generally sufficient only to give the fibres sufficient cohesion to withstand the winding tension. The winding tension itself is determined by the drag applied to the bobbin and in one common arrangement the bobbin is supported on a rotary bobbin carrier to which a braking action is applied to provide the necessary drag.

Most commonly the underside of the bobbin carrier is provided with pads of friction material which run on a stationary supporting surface and thus exert a frictional braking torque. Relatively coarse adjustment of this torque may be made in accordance with the nature of the material being wound by adjustment of the pitch diameter of the friction pads, but once the pads have been adjusted, the drag will be constant for the whole of the winding operation. On the other hand, the effective radius at which the tension in the material being wound acts on the bobbin in order to overcome the drag increases steadily as the package is wound so that notwithstanding the increasing package weight, the tension in the material decreases steadily with increasing diameter of package.

With normal yarn spinning and twisting operations these variations in tension are usually of no major consequence, but when winding a much heavier package of sliver or rove in which the final diameter may be several times the starting diameter, the low twist applied means that the sliver or rove is less able to withstand variations in tension. As mentioned above, when using friction pads which must remain at a fixed pitch diameter throughout a winding operation, the drag decreases steadily during the winding operation and consequently if the drag is sufficient to form a reasonably firm package at the completion of winding, it may be excessively high at the start of the operation and we have discovered that in some cases excessive tension in the rove or sliver may lead to uncontrolled drafting between the delivery rollers and the bobbin.

According to the present invention, a textile winding head of the driven flyer type having a rotary bobbin carrier is provided with an adjustable brake of the electro-magnetic induction type and a controller for increasing the braking torque progressively as the diameter of the package increases during winding so as to maintain close control over the tension of the material being wound. In other words, the electro-magnetic induction brake takes the place of the friction pads used previously and, owing to the flexible nature of the control operates to increase the braking torque progressively as the diameter of the package increases during winding. In contrast with the complete lack of adjustability during operation of mechanical friction pads, it is a relatively simple matter to adjust a brake of the electro-magnetic induction type during operation so as to regulate the amount of energy absorbed and hence the braking torque applied. For the reasons mentioned above, this is of primary importance in the winding of heavy packages so as to avoid excess tension at the start of operation, but the enhanced uniformity of tension resulting from a braking arrangement in accordance with the invention also leads to improvement in packages of yarn produced on a spinning or twisting head, particularly in respect of increased uniformity in the density of the package.

A further problem which arises from the use of mechanical friction pads for the application of drag to a bobbin carrier lies in the dispersion of the heat generated by the braking effort. Again this is of considerably more importance when winding heavy packages of sliver or rove than when winding much smaller packages of spun or twisted yarn. Generally speaking, the supporting surface on which friction pads have run in the past can be made large enough to constitute a heat sink for absorbing any heat generated during the formation of normal sizes of package, but even under these circumstances, significantly high temperatures can sometimes be reached. When winding heavy packages of sliver or rove, however, much more heat is generated. This may represent a limiting factor in the weight of package which can be wound and also necessitates specific cooling arrangements. Packages of this kind are used as the material feed source for spinning frames and maximum capacity is therefore naturally desirable.

When using an electro-magnetic induction brake in accordance with the invention this may be so designed as to avoid the generation of any appreciable quantity of heat in the locality of the bobbin carrier and its support. Such a result is preferably achieved by designing the brake to act regeneratively so that the current generated as a result of absorption of energy from the bobbin carrier is fed back to the main supply and does not appear as heat at all. Alternatively, the braking assembly may have a winding connected to a loading device situated at a remote point. As a consequence, heat generated by current induced in the winding as a result of braking action is dissipated at a point remote from the brake.

Even if the design of the brake is such that the heat is generated locally, e.g. in the form of eddy currents in a part of the brake assembly, which may be quite acceptable when winding normal size packages, the much greater flexibility obtainable by the ability to adjust the braking effort during the winding operation represents a major advantage over mechanical braking.

In whatever way the electrical energy generated in the brake is dissipated, this is usually required to vary substantially directly with the diameter of the package, as explained above. Although it is possible to sense the diameter of the package, e.g. mechanically, and to use the value of the diameter as a control factor in adjusting the braking torque, it is preferred instead to measure the angular velocity of the package. Assuming, as will generally be the case, that the rate of delivery of the material to be wound and the angular velocity of the flyer are substantially constant, the angular velocity of the package will increase proportionately as its diameter increases. Accordingly, the braking torque needs to be adjusted in proportion to the angular velocity of the package.

For this purpose, a winding head in accordance with the invention may include a tachogenerator connected to turn with the bobbin carrier to provide a signal varying with the angular velocity of a package being wound to serve as an input to the controller to adjust the braking torque accordingly. A winding head will normally include a pair of delivery rollers and variations in the speed of the drive to these rollers and also to the flyer will inevitably affect the tension in the material being wound. Additional tachogenerators may therefore be connected to turn respectively with the delivery rollers and the flyer to provide correction signals should either of these two angular velocities depart from the assumed constant value. Under these circumstances, the controller needs to be in the form of a computer which receives the basic signal from the tachogenerator turning with the bobbin carrier together with the two correcting signals just mentioned so as to provide an output signal for adjusting the braking torque.

Since different materials to be wound can withstand different degrees of tension, different starting values for the braking torque may be required. Preferably, therefore, the computer which provides the control signal for the adjustment of the braking torque is manually adjustable so as to regulate the value of the initial tension setting. This adjustment is made at the beginning of winding and once the manual adjustment has been made, the subsequent control is automatic as previously described.

The term "brake of the electro-magnetic induction type" indicates that the braking effort is achieved by the electro-magnetic induction of electric currents which are either used regeneratively, that is to say fed back to the main supply or are dissipated in a load device, e.g. in the form of heat. In the simplest form of an arrangement in accordance with the invention, therefore, the energy is dissipated in the form of heat in situ, i.e. in the structure of the brake itself. Thus the brake assembly may include a permanent magnet or an assembly of such magnets which operate either to induce eddy currents in a drum or disc or circulating currents in a short-circuited winding. The magnitude of the current induced may be adjusted by corresponding adjustment of the working air gap between the parts of the assembly by means of mechanism responding to a control signal derived as previously described, and in this way the braking torque itself is adjusted in accordance with the control signal. For example, permanent magnets may be adjusted either in a radial direction or in an axial direction in relation either to an eddy current disc rotating with the bobbin carrier or in relation to a short-circuited rotor mounted in a similar way. Heat is then generated either in the eddy current disc or in the winding and cooling arrangements may be provided if required.

If the heat is to be dissipated at a remote point, an electrical winding is necessary which is connected to a load device at the point in question. Various methods of control are possible including adjustment of the air gap as just described or, for example, by maintaining a constant air gap and adjusting the loading device. The winding may constitute a rotor turning with the bobbin carrier and co-operating with stationary magnets or, alternatively a permanent magnet rotor may be used co-operating with a wound stator assembly. In these circumstances, the brake assembly constitutes a form of electrical generator, the loading of which can be varied in accordance with the required braking torque.

If, as is preferred, the braking arrangement operates regeneratively, it conveniently includes a small electric motor, preferably D.C., which may, for example, be of the printed circuit type. Most simply this is energised to exert torque in opposition to that transmitted from the bobbin carrier. In operation this torque is overcome by that of the bobbin carrier so that the motor effectively operates in reverse as a generator and the current induced flows back into the supply. By progressively increasing the motor torque, e.g. by increasing the current under thyristor control, the braking torque is regulated as required in accordance with the angular velocity of the bobbin. As an alternative, the motor may be energised to run in the same direction as the bobbin carrier but at a slower speed so that when it is effectively over-run by the bobbin carrier a similar effect occurs and the motor operates as a generator to feed current back to the supply. Since the motor is turning at a speed directly related to that of the bobbin carrier, the control signal may be derived directly from the motor itself, thus avoiding the need for a separate tachogenerator.

Any of the forms of braking arrangement so far described can either be connected directly to the bobbin carrier or alternatively may be connected indirectly, e.g. by means of gearing or more simply by means of a toothed driving belt or chain. This gives rise to the possibility of a single braking arrangement, e.g. a single motor or generator, controlling a number of bobbin carriers. For example, a particular construction of heavy packaging machine may include four separate winding heads, and these may be controlled by an individual braking motor for each head, a pair of somewhat larger motors each controlling two heads or a single motor controlling all four heads.

If a single motor is used to control more than one head, it is desirable to provide for the possibility of an end break in one of the heads so as to avoid the risk of excessive braking torque being applied to the other head or heads. Under these circumstances each winding head may also include a detector for sensing the presence of textile material passing to the flyer and responsive to the absence of such material to provide a signal to the computer to reduce accordingly the braking torque applied to the other bobbin carrier or carriers. For example, if a single motor controls two heads, breakage of the material being supplied to one head will cause operation of the respective detector so that the signal will be supplied to the computer causing the applied braking torque to be immediately halved. Of course, both heads need to be stopped to enable the broken material to be pieced up, but the braking torque is reduced during the slowing down period. In order to allow each bobbin carrier to be turned freely during piecing up, it may be fitted with a free wheel mechanism to enable it to be turned by hand in the reverse direction.

An example of a winding head in accordance with the invention will now be described with reference to the accompanying drawings which is an elevation of the apparatus including electrical and electronic components.

The main components of the winding head are standard, comprising a pair of delivery rollers 2, a flyer 4 and a bobbin carrier 6. The sliver or rove to be wound is shown as 7 and after being fed downwardly by the delivery rollers 2 passes through a hollow spigot 8 at the head of the flyer 4, which is supported by a rail 10. Only part of the vertical support of the frame end 3 is illustrated in order not to obscure the drawing. The flyer 4 may be constructed in accordance with British Pat. No. 1,282,001 and after passing through the hollow spigot 8, the sliver or rove extends down one leg of the flyer as seen at 11 and is then wound onto a bobbin 12 carried by the bobbin carrier 6, being guided by a finger 14 onto the surface of the package.

The main drive is taken from a motor 16 which drives a shaft 17 by way of a belt drive 18. The shaft 17, in its turn, drives the delivery roller 2 by way of a belt 19 and the flyer 4 by way of a gear box 20 and a belt drive 21. The bobbin carrier 6 to which the bobbin 12 is firmly connected has a spindle 24 which passes downwardly through bearings in a builder rail 25 which has the normal vertical reciprocating movement for the building of the package on the bobbin 12.

Braking of the bobbin carrier 6 is produced by an electric motor 28 having a shaft 29 which is connected to the spindle 24 of the bobbin carrier 6 by a toothed driving belt 30. The magnitude of the braking torque applied to the bobbin carrier 6 is regulated by appropriate control of the electric motor 28 as will now be described.

The control for the motor 28 which may, for example, be a printed circuit DC motor, is derived from a computer indicated generally as 35 which produces an output signal by way of leads 36 to adjust a thyristor control unit 37 through which the main supply to the motor 28 passes as indicated at 38. The motor 28 exerts a torque opposing rotation of the bobbin carrier 6, but since the torque of the motor is overcome during operation, the motor effectively acts as a generator and the effect of the computer control is to adjust the mains supply voltage at 38 to a value less than that of the output voltage of the motor 28 so that regenerated current passes back to the main supply.

The main input signal to the computer 35 is taken from a tachogenerator 40 driven from the spindle 24 of the bobbin carrier 6 by a belt drive 41. The output of the tachogenerator 40 and hence the main input signal to the computer 35 therefore varies with the speed of the bobbin carrier 6, and the computer responds to this so as progressively to increase the braking torque as the package on the bobbin 12 builds up, i.e. as the speed of the bobbin 12 and hence the bobbin carrier 6 increases. In order to allow for minor variations in the speed of the flyer 4 and that of the delivery rollers 2, secondary input signals to the computer 35 are taken from a second tachogenerator 42 driven by the motor 16 and a third tachogenerator 44 driven by the motor 16. These secondary input signals apply a second order correction to the main input signal from the tachogenerator 40.

Although not specifically illustrated, the computer 35 has a manual control whereby the initial value of the braking torque and hence the tension applied to the textile material being wound may be set at the start of winding in accordance with the characteristics of the material. Once this initial setting has been made, subsequent adjustment is carried out automatically by the computer 35 as already described. Supply to the main drive motor 16 is taken from the mains supply at 45 by way of a thyristor control unit 46 which causes the supply voltage to build up at a controlled rate and thereby avoids sudden starting of the machine.

As so far described, the winding head operates individually, that is to say, the braking torque applied to the bobbin carrier 6 by the motor 28 is adjusted quite independently of that applied to any other winding heads in the same machine. As described previously, however, a single motor 28 may apply braking torque to more than one winding head and this possibility is illustrated by the provision of a second toothed belt drive 50 on the output shaft 29 of the motor 28. This belt drive is shown as broken away in the drawing, but in practice extends to apply braking torque to the bobbin carriers of one or more further winding heads. To allow for the possibility of an end break in any one of the associated heads, which would otherwise apply excessive braking torque to the other head or heads, an end break detector 52 is provided which takes the form of a photoelectric detector situated adjacent the path of the sliver or rove between the delivery rollers 2 and the flyer 4. In the event of an end break, an input signal from the detector 52 is passed to the computer 35 and the braking torque of the motor 28 is thus adjusted accordingly. When more than one winding head is controlled by the motor 28 in this way, it is necessary to allow each bobbin carrier 6 to be turned freely during piecing up and for this purpose a free wheel mechanism 54 is provided.

I claim:

1. In a textile winding head of the type comprising a flyer, means for rotating said flyer, means feeding a textile strand to said flyer, a bobbin carrier, braking means for said bobbin carrier and means for producing relative reciprocating movement between said flyer and said bobbin carrier to form a wound package of said textile strand on a bobbin supported by said bobbin carrier, the improvements which comprise: said braking means being of the regenerative electromagnetic induction type, means responsive to the diameter of a package being wound for producing an output signal, a controller responsive to said output signal for producing a control signal, and means responsive to said control signal for adjusting said braking means.

2. A textile winding head according to claim 1, wherein said means responsive to said package diameter comprises a first tachogenerator, and means connecting said tachogenerator to turn with said bobbin carrier to provide an output signal varying with the angular velocity of said package.

3. A textile winding head according to claim 2, wherein said means for feeding a textile strand includes a pair of delivery rollers, second and third tachogenerators, means connecting said second and third tachogenerators to turn respectively with said delivery rollers and said flyer to provide correction signals, said controller being in the form of a computer for receiving the signals from said first, second and third tachogenerators and for providing an output signal for adjusting said braking torque.

4. A textile winding head according to claim 3, further including manually adjusting means for said computer to regulate the value of the initial tension setting of said textile strand.

5. A textile winding head according to claim 1, wherein said braking means is constituted by an electric motor connected to said bobbin carrier.

6. A textile winding head according to claim 5, including means energising said electric motor to exert torque in opposition to the torque transmitted from said bobbin carrier.

7. A textile winding head according to claim 6, including thyristor control means for regulating the current to said motor.

8. A textile winding head according to claim 5, including a driving connection between said bobbin carrier and at least one further bobbin carrier of a similar winding head, whereby said electric motor is connected to apply braking torque also to said further bobbin carrier, said winding head also including a detector for sensing the presence of a textile strand passing to said flyer and responsive to the absence of such strand to provide a signal to said computer to reduce accordingly the braking torque applied to said further bobbin carrier.

9. A textile winding head according to claim 8, further including a free wheel mechanism fitted to said bobbin carrier to allow said bobbin carrier to be turned independently of said braking motor.

* * * * *